US005641163A

United States Patent [19]

McCloud

[11] Patent Number: 5,641,163

[45] Date of Patent: Jun. 24, 1997

[54] TABLE SOCCER PLAYING FIGURE

[75] Inventor: Calvin Edward McCloud, Fort Worth, Tex.

[73] Assignee: Tornado Table Sports, Inc., Fort Worth, Tex.

[21] Appl. No.: 416,160

[22] Filed: Apr. 4, 1995

Related U.S. Application Data

[62] Division of Ser. No. 145,407, Oct. 29, 1993, Pat. No. 5,419,555, which is a division of Ser. No. 954,678, Sep. 30, 1992, Pat. No. 5,333,864, which is a continuation of Ser. No. 626,023, Dec. 12, 1990, abandoned.

[51] Int. Cl.[6] ..... A63F 7/06

[52] U.S. Cl. ..... 273/108.52; 273/129 W; 273/119 R

[58] Field of Search ..... 273/85 R, 85 A, 273/85 B, 85 C, 85 D, 85 E, 85 F, 119 R, 129 V, 129 W, 129 T, 108.52, 108.54, 108.55, 108.56, 108.1

[56] References Cited

U.S. PATENT DOCUMENTS

| | | | |
|---|---|---|---|
| 3,047,295 | 7/1962 | Sachs . | |
| 3,653,661 | 4/1972 | Leonhart | 273/85 D |
| 3,785,648 | 1/1974 | Kobayashi | 273/85 B |
| 3,870,303 | 3/1975 | Patterson, Jr. | 273/85 D |
| 3,913,913 | 10/1975 | Trbovich et al. | 273/85 B |
| 3,920,244 | 11/1975 | Kaiser | 273/85 D |
| 3,926,432 | 12/1975 | Furr et al. | 273/85 D |
| 4,025,073 | 5/1977 | Furr et al. | 273/85 D |
| 4,046,378 | 9/1977 | Furr | 273/85 D |
| 4,076,244 | 2/1978 | Peppard | 273/85 D |
| 4,127,269 | 11/1978 | Rest | 273/85 D |
| 4,138,110 | 2/1979 | Hendrickson | 273/85 D |
| 5,071,137 | 12/1991 | McCloud | 273/85 D |
| 5,333,864 | 8/1994 | McCloud | 273/85 D |
| 5,419,555 | 5/1995 | McCloud | 273/85 D |

FOREIGN PATENT DOCUMENTS

| | | | |
|---|---|---|---|
| 746550 | 3/1933 | France . | |
| 834474 | 4/1938 | France . | |
| 980203 | 12/1950 | France . | |
| 985312 | 3/1951 | France . | |
| 991037 | 6/1951 | France . | |
| 1031894 | 3/1953 | France . | |
| 1034971 | 4/1953 | France . | |
| 1039299 | 5/1953 | France . | |
| 1066421 | 6/1954 | France | 273/85 D |
| 1359795 | 3/1964 | France . | |
| 2057981 | 8/1971 | Germany | 273/85 D |
| 518959 | 3/1955 | Italy . | |
| 356393 | 9/1961 | Switzerland . | |
| 390764 | 8/1965 | Switzerland . | |
| 466774 | 1/1969 | Switzerland . | |

OTHER PUBLICATIONS

Photographs of Playing Figures on sale more than one year before Dec. 12, 1990, attachment to IDS of Jul. 18, 1995.

*Primary Examiner*—Sebastiano Passaniti
*Attorney, Agent, or Firm*—Learman & McCulloch

[57] ABSTRACT

An integrally molded table soccer playing figure has an elongated body with head and foot portions disposed at its opposite ends. A cylindrical passage axially extends laterally through an upper portion of the body and is adapted to coaxially receive a longitudinal portion of an actuating rod used to rotate and translate the playing figure. The body passage is diametrically sized to create a press-fit between the body portion and the rod portion therein, and the body is mechanically locked to the rod by a small roll pin longitudinally inserted through aligned openings in the body and rod. Integrally formed on opposite lateral sides of the body portion are relatively large diameter force receiving and diffusing washer portions. Undesirable distortion of the precisely contoured front and rear ball-engaging surfaces of the foot portion, and the formation of undesirable cavities within the foot portion, during molding of the playing figure are essentially eliminated by a molding passage extending laterally through the foot portion. In a similar fashion, undesirable molding distortion of the body is substantially eliminated by the provisions of vertically elongated recesses formed in the opposite front and rear sides of the body. The front and rear foot portion surfaces are specially contoured to enhance the ball-handling characteristics and playing style adaptability of the playing figure.

4 Claims, 2 Drawing Sheets

TABLE SOCCER PLAYING FIGURE

This a divisional of application Ser. No. 08/145,407, filed Oct. 29, 1993 (issued as U.S. Pat. No. 5,419,555 on May 30, 1995), which was a divisional of application Ser. No. 07/954,678 filed Sep. 30, 1992 (issued as U.S. Pat. No. 5,333,864 on Aug. 2, 1994), which was a continuation of application Ser. No. 07/626,023, filed Dec. 12, 1990 (abandoned).

BACKGROUND OF THE INVENTION

1. Field of the Invention

The invention relates to playing figures for use in table soccer or fussball game structures and, more particularly, to an improved playing figure construction.

2. History of the Prior Art

The game of table soccer, also known as fussball, has developed into a very popular pastime in recent years. Players of the game have likewise advanced in the skill necessary for competitive play. These developments have led to a myriad of improvements in the game table structure. One such improvement is shown in U.S. Pat. No. 3,926,432 issued Dec. 16, 1975 to Robert L. Furr and Robert I. Hayes, Jr. As set forth therein, both the game table surface and the playing figures themselves have been designed for better ball control and player enjoyment. These aspects are critical to efficient ball control and player enthusiasm.

Fussball game tables typically include a rectangular, box-like playing table structure supported on a plurality of legs at about waist height of a player. A plurality of axially slidable and rotatable actuating rods are mounted to extend transversely of the playing area. The actuating rods mount a plurality of playing figures which are arranged above the playing surface of the table in a preselected formation. A ball is placed on the playing surface and propelled by sharply rotating the actuating rods so that a foot of a playing figure strikes the ball and propels it along the playing surface toward one of the two goals located in opposite end walls of the table structure.

In playing the game of table soccer, skilled players repeatedly manipulate the playing ball back and forth between adjacent ones of their playing figures to set up a clear path between the ball and their opponent's goal opening. Such manipulation includes passing the ball from one playing figure to another. A pass is effected through propelling the ball to one figure by striking it with the foot portion of a different figure. Another technique often used by players is that of manipulating a ball transversely with the rear foot portion of a figure and then suddenly circling the ball and shooting with the front of the foot portion. A ball passed from one figure to another is best caught with a receiving figure by first rotating the associated actuating rod to raise the foot portion to trap the ball between the foot portion and the playing surface of the table.

The front and rear surfaces of the foot portion of prior art playing figures greatly facilitated gripping a ball between the foot and the playing field surface. Likewise, in striking the ball, the relative positioning between the ball and playing figure determines the lift or spin imparted to the ball. This effect is due to the "varying" point of engagement of the ball resulting from its radial distance from the actuation rod. Such geometric considerations are integral in the ultimate functioning of fussball structures.

Problems associated with the manufacture and use of fussball playing figures include functional aspects such as ball control and effective shooting, as well as structural aspects related to the design of the playing figure, its mass distribution, structural strength and mounting features thereof.

Structurally, a fussball playing figure must withstand a wide range of forces which are imparted both rotationally and axially thereto. The force that some players use in the game of fussball is considerable and a fussball playing figure can be broken, and/or the playing rod bent, through inherent structural weakness if the playing figure is not properly designed.

The aforementioned problems include the interconnection between the playing figure and the actuating rod. In many instances, the playing figure is sized to be easily received upon the actuating rod and bolted thereto. The bolting configuration requires that an aperture be formed through the playing figure and through the rod through which a threaded member can be received. The stresses generated by the threaded member can induce fatigue failure to the rod, the weakness resulting therefrom contributing to failure of the rod during an intense play.

Likewise, the playing figure itself must be fabricated to withstand enormous rotational as well as axial forces. The sides of the playing figure are generally formed to receive a fiber washer, which washer serves to engage the side bumper of the fussball playing area, to absorb shock therefrom, when the playing figure is an end figure in the spaced series of figures typically secured to an actuating rod. If a suitable washer is not provided, the stress between the playing figure and the bumper can be considerable and may not be properly diffused.

Another structural aspect of the playing figure is the foot portion itself. A variety of playing surface configurations have been incorporated into the foot region but many of these relate primarily to the functional aspect of the playing figure such as ball control and effective "shooting". For example, U.S. Pat. No. 4,046,378 addresses one aspect of ball control utilizing a pebbled striking surface on the playing figure foot.

The front surface of the playing figure set forth in this patent is pebbled over with its entire surface and lies in a plane angled rearwardly with respect to the longitudinal axis of the figure. The rear foot surface is also pebbled over most of its entire surface and lies in a plane angled forwardly with respect to the longitudinal axis of the figure except for an unpebbled control corner extending horizontally along the lower rear edge of the foot in a plane parallel to both the vertical and horizontal axis of the figure. The control corner increases the firmness with which a playing ball may be trapped between the playing foot and the playing surface.

The fabrication of the foot portion with such intricate features requires close fabrication control and tolerances. The sheer size of the playing foot and the thickness thereof requires that care be given to the manner in which material is molded into the playing figure itself. The necessary thickness of the foot can result in surface irregularities due to the thermal coefficients of expansion of the material and/or unplanned voids formed therein during the fabrication process.

With bubbles or other undesirable cavities formed underneath the playing foot surface, or with uncontrolled expansion or contraction of the material during molding and/or cooling, surface irregularities can occur which reduce the flatness of the surface configuration. When there is not appropriate flatness, the effectiveness of the surface for shooting the playing ball is jeopardized. Moreover, the surface must be rigidly associated with the upper body portion of the playing figure and concomitantly with the actuating rod.

The same constructional aspects are present in the fabrication of the playing figure with regard to the depending portion connecting to the foot. Axial tolerances must be maintained without serious deformation during the cooling process. These and other structural and functional features must be considered in the proper fabrication and use of a fussball playing figure.

As mentioned above, a variety of playing surface configurations have heretofore been incorporated into the foot portions of conventional table soccer playing figures to enhance one or more of their ball handling capabilities such as shooting, trapping and passing. The result of this non-standardization of foot configuration has been that skilled players using playing figures having a given foot configuration tend to develop a certain playing "style" which takes advantage of the special ball-handling capabilities of that particular foot configuration.

However, when these players switch to table soccer games whose playing figures have different foot portion configurations the players often find that the different foot configuration, while possibly having advantages of its own, does not permit them to carry out all of their previously learned ball-handling maneuvers as well or in the same manner as with the previous foot configuration. This often necessitates undesirable changes in the player's shot repertoire and overall playing style. It would thus be desirable to provide a foot portion configuration which could accommodate a wider variety of playing styles and ball-handling techniques.

It would be an advantage to overcome the problems of the prior art by providing a fussball playing figure having the requisite structural strength, balance and functional features for maximum reliability while affording the user the ultimate in versatility. The present invention overcomes the problems of the prior art by providing a fussball playing figure constructed with a number of features facilitating reliability and improved functional aspects.

For example, the playing figure is constructed with a central aperture formed through the upper body portion thereof adapted for receiving the actuating rod, the aperture being sized for a press fit interengagement with the actuating rod and having a relatively small aperture formed orthogonally therethrough adapted for receipt of a roll pin therein. In this manner, the actuating rod contains an aperture of a smaller diameter and adapted to receive the roll pin in a mounting configuration providing increased strength relative to conventional threaded fastener techniques.

The playing figure is also constructed with a foot region having a predefined aperture formed laterally therethrough of a size and configuration adapted for reducing the inherent problems of material mass and surface area deformation often resulting therefrom. The foot is also connected to the upper body region by a leg portion constructed in generally I-beam configuration affording increased strength and reduced mass for structural rigidity between the foot and the upper body.

The upper body is also fabricated with sidewall portions integrally formed therein and configured in the shape of the fiber washer conventionally affixed thereto. In this manner, a single structure affords the functional features necessary for direct mounting upon the actuating rod without the requirement that additional fiber washers be utilized or threaded fastener members that can result in degradation in the actuating rod itself.

The playing figure foot portion is additionally provided with a specially designed exterior surface configuration which easily accommodates a wide variety of different playing styles and ball-handling techniques which may have been learned and developed using playing figures with markedly different foot portion configurations.

SUMMARY OF THE INVENTION

In carrying out principles of the present invention, in accordance with a preferred embodiment thereof, a structurally and operationally improved table soccer game playing figure is provided. The playing figure is of an integrally molded construction and comprises an elongated body having opposite front and rear sides, opposite lateral sides facing perpendicularly to the front and rear sides, a head portion disposed on the top end of the body, and a foot portion disposed on the bottom end of the body.

A cylindrical passage axially extends laterally through an upper end portion of the body and is adapted for coaxial insertion therethrough of an elongated actuating rod to position a predetermined longitudinal portion of the rod within the passage, the rod portion having a connection opening extending transversely therethrough. A diametrically opposed pair of connector member openings are formed through the front and rear sides of the upper body end portion and are outwardly alignable with the rod portion connection opening.

According to a feature of the present invention, the diameter of the cylindrical body passage is made smaller than the outer rod diameter to an extent such that a press-fit engagement is created between the inner side surface of the passage and outer side surface of the rod portion upon entry of the rod portion into the passage. This press-fit engagement strongly inhibits relative axial and rotational movement between the upper body end portion and the rod portion received therein by creating an outwardly directed contact force, and a resultant static frictional force, which are essentially uniformly distributed around the inner side surface periphery of the body passage.

The releasable anchoring of the playing figure to the actuating rod is completed by longitudinally pressing a relatively small diameter roll pin into the aligned transverse connection openings in the upper body end portion and the longitudinal rod portion press-fitted therein. The inserted roll pin serves to mechanically block relative rotational and translational movement between the body portion and rod portion without materially disrupting the essential uniformity of the playing figure/actuating rod connection force distribution.

This unique combination of the uniform press-fit engagement and the roll pin which does not exert appreciable transverse connection forces on the upper body portion essentially eliminates the undesirable connection stress concentrations, on both the playing figure and the actuating rod, which typically arise when the playing figure is conventionally tightened against the rod using a transverse connecting bolt. Accordingly, the anchored playing figure is better able to withstand lateral impact forces arising when the figure is on one end of the typical series of figures secured to an actuating rod. Moreover, the press-fit/roll pin combination provides more protection for the actuating rod by virtue of the lateral resiliency of the roll pin coupled with the aforementioned uniformity of the press-fit.

According to another aspect of the present invention, the playing figure is further protected from lateral impact damage by configuring the opposite lateral sides of its upper body end portion in the shape of radially enlarged washers which coaxially circumscribe the body passage and project outwardly beyond the opposite lateral sides of the playing figure heat portion. The outer side surfaces of these integral washer portions of the body form expanded area side stops for the playing figure which function to receive and protectively diffuse side impact loads thereon, from a table side wall, when the figure is at either end of the spaced playing figure array on the actuating rod. This advantageously eliminates the necessity of utilizing separate fiber washers to cushion side impact loads, and substantially strengthens the playing figure.

The foot portion of the playing figure is critical to the playing accuracy of the figure and has precisely contoured front and rear ball-engaging surfaces extending between essentially flat opposite lateral side surfaces of the foot portion. According to another feature of the present invention, a relatively large molding opening is formed in the foot portion and extends between these opposite lateral side surfaces. The molding opening functions to essentially prevent distortion of the precise contours of the front and rear foot portion side surfaces, and the formation of undesirable voids within the foot portion, during the molding of the playing figure. Additionally, to preserve the precise longitudinal linearity of the elongated playing figure during its molding, elongated, relatively deep surface depressions are formed on the front and rear sides of the body and longitudinally extend from adjacent its upper end portion to adjacent its foot portion.

In a preferred embodiment of the present invention, the critical foot portion of the playing figure is preferably provided with a specially designed exterior surface contour that substantially improves the ball-handling capabilities of the foot portion while at the same time significantly increasing the adaptability of the foot portion to a wide variety of playing "styles" previously learned and developed by players using playing figures with foot portions of markedly different configurations.

According to this feature of the present invention, the edges of the foot portion, at the junctures between the lateral sides of the foot portion and its front end rear side surfaces, do not form sharp corners as is typical in conventionally configured playing figure foot portions. Instead, these edges are radiused to provide two primary advantages. First, the radiused foot portion edges do not tend to gouge the game ball when forcibly brought into contact therewith. Second, the radiused edges provide for better ball control when the ball is being contacted and propelled using an edge portion of the foot. Since sharp foot portion edges are not present, the exact positioning of the foot portion edge on the ball is not nearly as critical, and a greater margin for error in edge portion placement on the ball is advantageously provided.

Upper sections of the front and rear side surfaces of the foot portion are generally planar, while the lower sections of these surface are curved and join at their bottom ends to form a rounded lower end of the foot portion. The upper section of the rear side surface, and these curved lower front and rear side surface sections are pebbled to enhance their ball gripping capabilities. The generally planar upper section of the front side surface is not pebbled, but is provided with a spaced series of vertically extending surface ridges thereon.

The pebbled upper section of the rear side surface facilitates the trapping of the game ball for lateral passing purposes and other lateral ball maneuvers, while the curved and pebbled lower sections of the front and rear side surfaces of the foot portion facilitates the trapping of the ball in preparation for a subsequently executed forwardly or rearwardly directed "pin" shot. The vertically ribbed but unpebbled upper section of the front side surface enhances its forward ball shooting accuracy, but advantageously prevents such surface section from trapping the game ball between the foot portion and the playing surface.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

As disclosed more fully in U.S. Pat. No. 3,926,432, incorporated herein by reference, a fussball game table includes a playing surface 10 shown in fragmentary perspective in FIG. 1, vertically extending end and sidewalls (not shown herein) and a plurality of actuating rods 13, rotatably mounted and axially slidable in opposite sidewalls. The actuating rods 13 are rotatably and slidably supported in a plurality of pairs of bearings (not shown) which are spaced along and in axial alignment with clearance apertures passing through the opposed longitudinal sidewalls.

Each actuating rod 13 slidably mounts one or more game FIGS. 18. Soft, shock absorbing, cylindrical rubber bushings are rigidly mounted to each of the actuating rods 13 and are located outside the outermost game FIGS. 18 on each rod 13. The rubber bushings serve as bumpers to prevent the rod mounted game FIGS. 18 from striking too hard against the inner sides of the wall, even during vigorous playing as the actuating rods 13 are quickly shifted axially to move the figures carried thereby relative to the playing surface 10.

Figure 1:
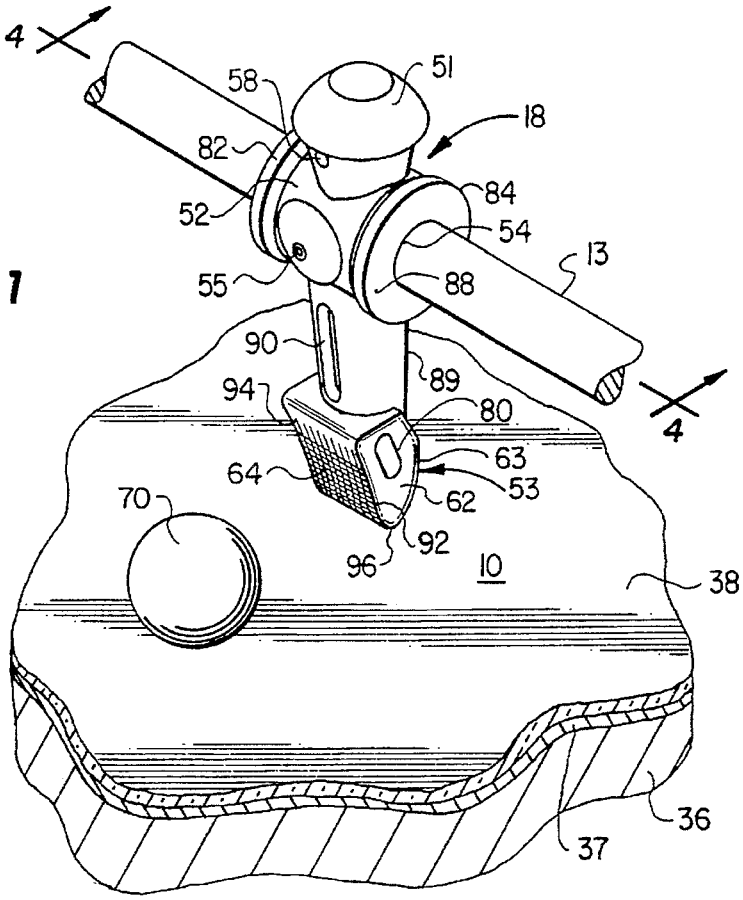
FIG. 1 is a perspective view of a fussball playing figure constructed in accordance with principles of the present invention and positioned upon an actuation rod above a playing surface.

Still referring to FIG. 1, there is shown a typical cutaway, perspective view of the playing surface of the table with sides and ends removed. While the particular pebbled configuration of the upper playing surface described herein is certainly unnecessary to practice the present invention, it is referenced herein for illustrating the aspect of ball control. This surface has been previously disclosed and claimed in a fussball table in U.S. Pat. No. 3,926,432. In FIG. 1, it can be seen how a wooden underlayer 36 supports a paper sheet 37 having a soccer field configuration printed thereon. The sheet 37 may be covered by a layer of glass 38. A ball 70 is representatively shown adjacent the foot portion 53 of the game figure 18.

Figure 2:
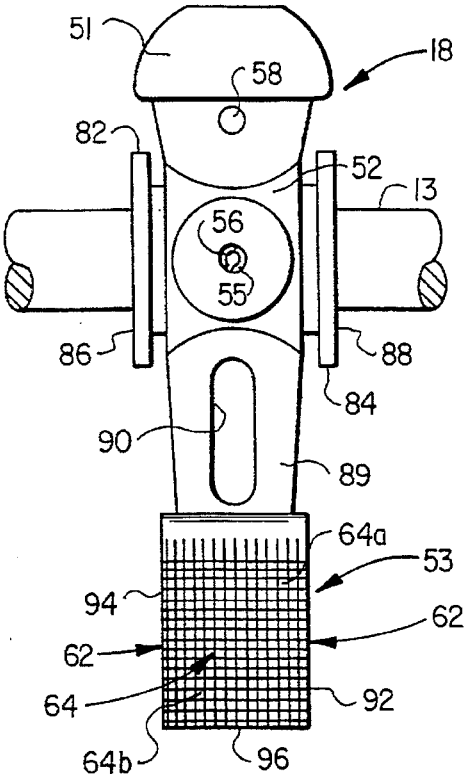
FIG. 2 is an enlarged rear elevational view of the fussball playing figure of FIG. 1.
Figure 3:
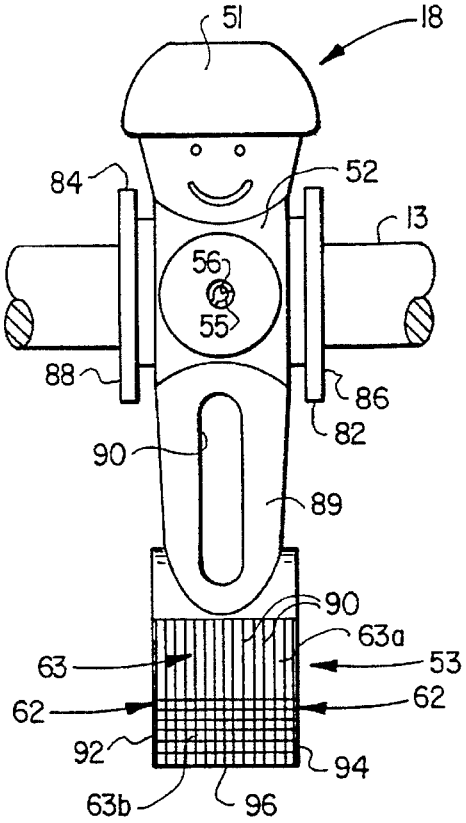
FIG. 3 is a front elevational view of the fuss ball playing figure of FIG. 1.

Referring now to FIGS. 2 and 3, the playing FIG. 18 constructed in accordance with the present invention is of an integrally molded plastic construction and includes a head portion 51, a body portion 52, and the foot portion 53. The body portion 52 is perforated by a close tolerance transverse, circularly cross-sectioned opening 54 for receiving, in press fit engagement, the actuating rod 13 therethrough. Small circular openings 56, transverse to the opening 54, are formed in front and rear sides of the body portion 52 to receive a roll pin 55 which also passes through a pair of aligned apertures $56_a$ in the actuating rod 13 (FIG. 4).

The foot portion 53 of the playing FIG. 18 is of extreme significance in that it is the means by which the ball 70 is manipulated and propelled toward an opponent's goal opening. The opposite lateral side surfaces 62 of the foot portion 53 are preferably smooth, flat and lie in generally vertical planes to facilitate lateral passing of the ball from one playing figure to another figure on the same rod by merely tapping the ball. The front and rear surfaces 63 and 64, respectively, of the foot portion 53 have precisely configured contours to facilitate select ball engagement, as described in more detail below.

Figure 4:
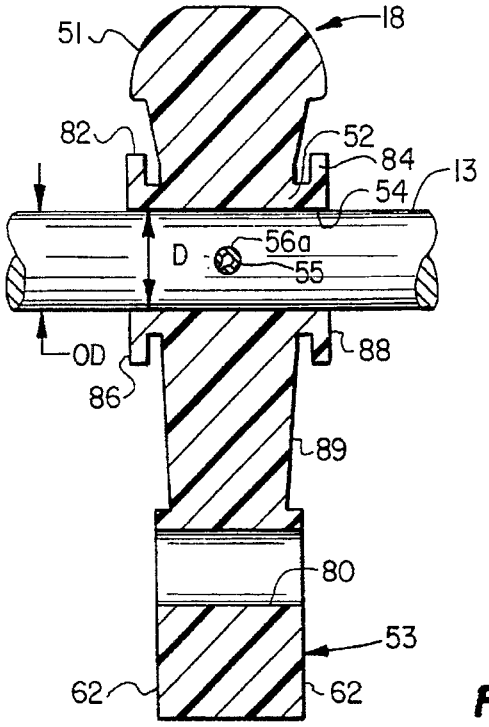
FIG. 4 is an enlarged scale cross-sectional view, partially in elevation, taken through the fussball playing figure and associated actuating rod along line 4—4 of FIG. 1.

Referring now to FIG. 4, there is shown a frontal elevational cross-sectional view of the playing figure of FIG. 1 taken along line 4—4 thereof. FIG. 18 is shown to be formed of solid molded plastic wherein aperture 54 comprises an elongate, lateral extension therethrough. The diameter D of aperture 54 is within 0.001" of the outside diameter (OD) of the rod 13 whereby the press fit engagement therebetween is one which affords close interengagement between the playing FIG. 18 and the rod 13.

This close fit interengagement negates the need for a threaded fastening member such as the type used in the prior art. Instead, the single roll pin 55 is received within the apertures $56_a$, 56 of the aligned rod 13 and playing FIG. 18. The presence of the expandable roll pin is to maintain the alignment between the respective pieces and provide mechanical blocking resistance to any relative movement between the FIG. 18 and rod 13. Because of the press fit interengagement however, between the rod 13 and the interior side surface of aperture 54, very minimal stress is applied to the roll pin of the magnitude that could cause fatigue failure within the actuation rod 13.

Still referring to FIG. 4, the foot portion 53 is constructed with a molding aperture 80 formed laterally therethrough between its opposite side surfaces 62, which aperture is sized and positioned to remove mass from the foot 53. The removal of mass in the molding process from the foot 53 eliminates much of the potential for deformation along the ball-engaging surface areas 63, 64 of the foot 53. The aperture 80 thus extends laterally through the foot 53 in generally parallel spaced relationship with the aperture 54 in the upper body region thereabove. As illustrated, the aperture 80 is cross-sectionally elongated in a direction parallel to the generally planar foot surface 64.

Another feature of the playing FIG. 18 is the presence of integrally formed washers or abutments 82 and 84 formed outwardly of the aperture 54. The washers 82 and 84 are sized to provide radially enlarged, flat annular abutment surfaces 86 and 88, spaced laterally outwardly of head portion 51, against which the playing FIG. 18 may engage the bumper of a fussball table. Each surface 86,88 terminates in a peripheral flange the peripheral edge of which is spaced from the body by an annular neck. Since all playing figures are interchangeable, it is impossible to determine at the time of manufacture which playing figure will be positioned on a rod at the outermost position whereby it will engage the bumper of the fussball table during the axial movement of the control rod 13. The integrally molded wide surfaces 86, 88 afforded by washers 82 and 84 provide sufficient engagement surface area to significantly reduce point stresses on the bumper and to further cushion the actuation thereof, and permits any figure to be an end figure on the actuating rod 13.

Figure 5:
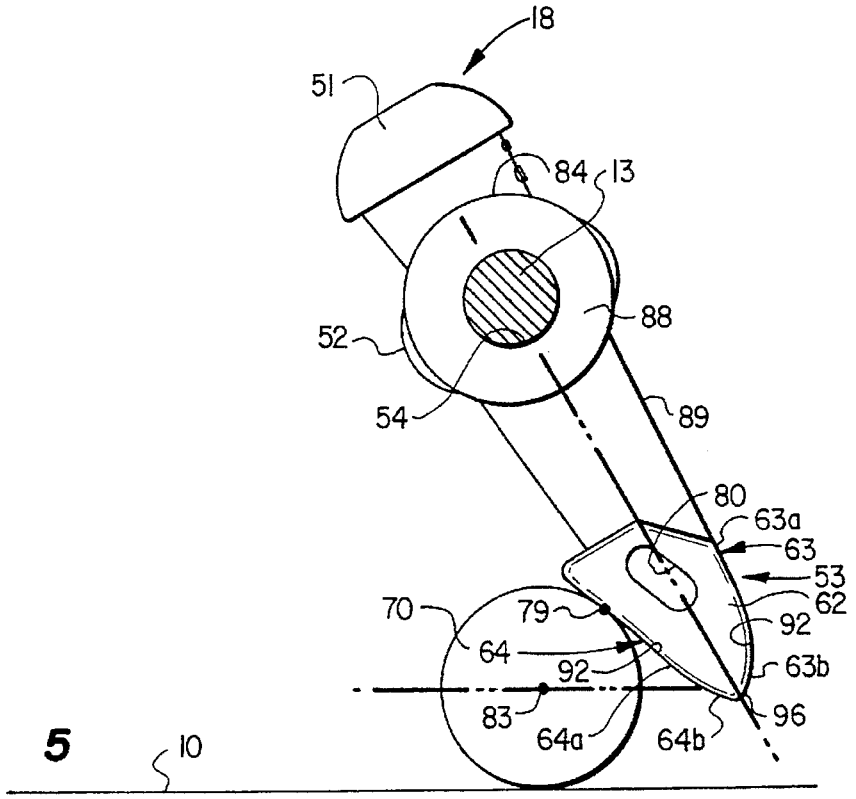
FIG. 5 is an enlarged scale lateral side elevational view of the FIG. 1 playing figure with a foot portion thereof operatively engaging the ball shown in FIG. 1.

Referring now to FIG. 5, there is shown a playing FIG. 18 in engagement with the ball 70. In FIG. 5 the playing FIG. 18 is shown in a position of rotation about the actuation rod 13. The ball 70 is shown to engage the foot portion 53 at a point 79. Point 79 is substantially above the center line of the ball 70 as drawn through center 83 thereof. Point 79 is on the rear foot surface 64 of the playing FIG. 18, which surface 64 is shown more clearly in FIG. 2 comprising an elongate roughened surface adapted for stopping the ball for purposes of positioning prior to shooting. In this position, the playing figure foot portion has in essence "trapped" the playing ball 70 and said ball may be slowly moved in position for spinning of the playing FIG. 18 about the actuation rod 13 for engagement by the front foot surface 63. The front foot surface 63 is shown most clearly in FIG. 3 to comprise a shortened area having the elongate flutings 90 formed therein adapted for enhancing lateral stability of the ball during the striking motion.

In operation, the playing FIG. 18 affords both the manufacturer and the user enhanced structural and functional properties. For the manufacturer, the design provides a playing figure having an integrally formed set of side washers 82 and 84 which provide uniform structural interengagement between the playing FIG. 18 and the bumper of the fussball table when engagement occurs from axial movement of the rod. This engagement of high force is further accommodated by the press fit interengagement of the actuation rod 13 within aperture 54 secured thereto by roll pin 55. The configuration is provided so that there is no normal or right angle force generated against the shaft 13 by a threaded member as prevalent in prior art configurations. This affords the user greater reliability and avails the user of the opportunity to apply appreciable forces to the rod and playing figure without degenerative effects therein.

As stated above, the presence of the molding aperture 80 formed in the foot 53 further eliminates manufacturing problems by providing an area of reduced mass, the surfaces of which may be formed in a relatively flat configuration in accordance with the original design and substantially unaffected by expansion and contraction as well as nonhomogeneous molding aspects that would otherwise possibly cause deformation and surface irregularities in the most critical area of the playing figure, that being the area in which the ball is contacted.

Finally, it is seen that the leg section 89 formed in an I-beam shape to provide the same advantages of reduced mass in the formation process to maintain the axial alignment of the foot 53 relative to the lateral aperture 54, while still affording the requisite structural rigidity in leg portion 89. The I-beam shape of leg portion 89 is achieved by the formation of vertically elongated, relatively deep surface recesses 90 in its front and rear sides, the recesses 90 extending from adjacent the upper body portion 52 to adjacent the foot portion 53. Those individuals using the fussball structure of the present invention may be able to utilize many manifestations of ball control and force with a reliable configuration which was not available in prior art embodiments.

In a manner similar to that illustrated and described in U.S. Pat. No. 3,926,432 the playing figure head portion 51 (FIGS. 1 and 2) has disposed therein a small weight member 58, the purpose of which is to rotationally balance the overall playing FIG. 18 so that it exerts no appreciable torque on the actuating rod 13 about its axis. The previously mentioned formation in the body portion 89 and the foot portion 53 of the surface recesses 90 and the molding passage 80 not only provides the molding accuracy advantages discussed above, but also substantially reduces the overall weight of body portion 89 and foot portion 53 which are disposed below the actuating rod axis in the vertical playing figure orientation shown in FIGS. 2 and 3.

This weight reduction in the lower longitudinal portion of the playing figure correspondingly raises the playing figure center of gravity toward the rod axis. In turn, this permits the head portion 51 to be vertically shortened, thereby enhancing a player's field of vision over the playing FIG. 18 when it is upright as shown in FIGS. 2 and 3, and advantageously increasing the ball clearance between the playing surface and the head portion 51 when the playing figure is upside down.

In addition to its other attributes previously discussed herein, the playing figure foot portion 53 is provided with a specially designed exterior surface contour which substantially improves its ball-handling capabilities while at the same time significantly increasing its adaptability to a wide variety of playing "styles" previously learned and developed by players using playing figures with foot portions of markedly different configurations.

According to one aspect of this improved surface contour the foot portion corner edges 92 and 94, formed at the junctures between lateral side surfaces 62 and the front and rear side surfaces of the foot portion, are radiused as best indicated in FIGS. 1 and 5. This corner edge radiusing essentially eliminates gouging of the game ball 70 when it is struck with an edge of the foot portion, and also provides for improved ball control when the ball is being contacted and propelled using a corner edge portion of the foot. Since sharp foot portion edges are not present, the exact positioning of the foot portion edge on the ball is considerably less critical, and a greater margin for error in edge portion placement on the ball is advantageously provided.

The overall front and rear side surface contours of the foot portion 53 are also specially configured in a manner which will now be described in conjunction with FIGS. 2, 3 and 5. As illustrated in these three figures, upper sections $\mathbf{63}_a$, $\mathbf{64}_a$ of front and rear foot portion side surfaces 63, 64 are generally planar, with section $\mathbf{64}_a$ being pebbled, and section $\mathbf{63}_a$ being unpebbled, but vertically ribbed as at 90 (FIG. 3). Pebbled lower sections $\mathbf{63}_b$, $\mathbf{64}_b$ of side surfaces 63, 64 are radiused, extend downwardly from the bottom ends of surface sections $\mathbf{63}_a$ and $\mathbf{64}_a$, and join at their lower ends to form a rounded bottom end 96 of foot portion 53.

During play, the pebbled upper rear surface section $\mathbf{64}_a$ facilitates the trapping of game ball 70 (FIG. 5) for lateral passing purposes and other lateral ball maneuvers, while the curved and pebbled lower surface sections $\mathbf{63}_b$, $\mathbf{64}_b$ facilitate the trapping of the ball, with a lower part of foot portion 53, in preparation for a subsequently executed forwardly or rearwardly directed "pin" shot. The vertically ribbed but unpebbled upper front side surface section $\mathbf{63}_a$ provides enhanced forward ball shooting accuracy when this surface section is used, the ribs 90 inhibiting lateral shifting of the ball relative to the foot portion while at the same time essentially preventing undesirable trapping of the ball between surface section $\mathbf{63}_a$ and the playing surface.

It is thus believed that the operation and construction of the present invention will be apparent from the foregoing description. Although the method and apparatus shown or described has been characterized as being preferred it will be obvious that various changes and modifications may be made therein without departing from the spirit and scope of the invention as defined in the following claims.

What is claimed:

1. In a unitarily molded table soccer playing figure of the type mountable on an actuating rod, as one of a longitudinally spaced plurality of playing figures mounted thereon, and having an elongated body with head and foot portions at its opposite ends; a passage extending transversely through said body along an axis and adapted to coaxially receive a longitudinal portion of the rod fixedly securable to said body; and first and second opposite lateral side surface portions spaced apart along and circumscribing said axis, one of said first and second side surface portions being subjectable to a high, potentially damaging lateral playing force when said figure is an end figure in said longitudinally spaced plurality of playing figures, the improvement comprising:

first protective means, unitarily molded integrally with said one of said first and second lateral side surface portions, for receiving and protectively absorbing said lateral playing force, said first protective means including a generally washer-shaped portion through which the rod may be passed, said generally washer-shaped portion having an annular outer side surface which is perpendicular to said axis, positioned laterally outwardly of said head portion, and radially enlarged relative to said one of said first and second lateral side surface portions which it shields from inwardly directed lateral impact force.

2. The improvement of claim 1 further comprising:

second protective means, unitarily molded integrally with the other of said first and second lateral side surface portions, said second protective means being substantially identical in construction, configuration and operation to said first protective means, whereby said playing figure may be utilized as either end figure in said longitudinally spaced plurality of playing figures.

3. A table soccer playing figure construction comprising a unitarily molded, elongate body having opposite ends, a transverse opening extending through said body from side to side and between its ends, said opening being of such size as snugly to accommodate an actuating rod having a longitudinal axis and by means of which said body may be reciprocated along said axis and rocked about said axis, said body including at each of its sides an annular enlargement forming a unitary part of said body, each said enlargement encircling said opening and extending radially outward thereof to form an abutment having a flat exposed surface terminating in a peripheral flange axially spaced from said body, the enlargement at one side of said body corresponding in all respects to the enlargement at the other side of said body, said enlargements enabling cushioning of impacts imposed on said body from either side thereof.

4. The construction according to claim 3 wherein each said peripheral flange has a peripheral edge spaced from said body by an angular neck.

* * * * *